US006182765B1

(12) United States Patent
Kilgore

(10) Patent No.: US 6,182,765 B1
(45) Date of Patent: Feb. 6, 2001

(54) SYSTEM AND METHOD FOR DEPLOYING A PLURALITY OF TOOLS INTO A SUBTERRANEAN WELL

(75) Inventor: Marion D. Kilgore, Dallas, TX (US)

(73) Assignee: Halliburton Energy Services, Inc., Dallas, TX (US)

( * ) Notice: Under 35 U.S.C. 154(b), the term of this patent shall be extended for 0 days.

(21) Appl. No.: 09/089,922

(22) Filed: Jun. 3, 1998

(51) Int. Cl.[7] ..... E21B 23/00
(52) U.S. Cl. ..... 166/381; 166/53; 166/102
(58) Field of Search ..... 166/379, 381, 166/83, 75.11, 85.1, 97.5, 102, 242.3, 70, 75.15

(56) References Cited

U.S. PATENT DOCUMENTS 2,713,909 * 7/1955 Baker ..... 166/70
3,545,474 * 12/1970 Brown ..... 166/70
4,260,022 * 4/1981 Van Bilderbeek ..... 166/97.5

* cited by examiner

*Primary Examiner*—William Neuder
(74) *Attorney, Agent, or Firm*—Paul I. Herman; David H. Hitt

(57) ABSTRACT

A system for, and method of deploying a selected one of a plurality of tools into a subterranean well and a well employing the system or the method. In one embodiment, the system includes: (1) a tool selector capable of receiving each of the plurality of tools into a separate location thereof and placing a selected one of the plurality of tools proximate an entrance to the subterranean well in response to a tool selection command and (2) a tool displacement mechanism, couplable to the selected one of the plurality of tools, that causes the selected one of the plurality of tools to enter and traverse at least a portion of the subterranean well.

30 Claims, 5 Drawing Sheets

SYSTEM AND METHOD FOR DEPLOYING A PLURALITY OF TOOLS INTO A SUBTERRANEAN WELL

TECHNICAL FIELD OF THE INVENTION

The present invention is directed, in general, to subterranean well completion, servicing and rework and, more specifically, to a system and method for deploying (and retrieving) selected ones of a plurality of tools into a subterranean well for purposes of completion, servicing or rework.

BACKGROUND OF THE INVENTION

Although modern oil and gas well production has progressed to a fine art, a variety of difficult problems may still be encountered during well completion, production, servicing and rework. Of necessity, these situations must be remedied from the well platform. Each well presents a unique challenge depending upon the well type, i.e., oil or gas, and the action to be taken. Typical problems requiring correction within a well are: crushed regions in the tubing, sand bridges or accumulation of paraffin, scale, rust or other debris. Maintenance procedures that must also be accomplished from the surface include the need to set or remove lock mandrels, collar stops or safety valves. Specific, commercially-available tools have been developed for each of these maintenance actions or problem solutions.

Although the actual tools may be very similar, at least three different prior art methods exist for powering the tools in the downhole environment. These methods for performing maintenance or for solving downhole problems are: wireline, pumpdown and plunger lift systems. As usual, each of these methods has both advantages and disadvantages.

Wireline systems use a variety of tools on the end of a wire acting through the flowline or wellbore. Various combinations of tools and accessories, e.g. swage, gauge cutter, broach, knuckle joint, stem, jars or accelerator, are assembled in a linear method creating a tool string which is used to perform the necessary action. Each tool string is custom-tailored to perform a required function. In wireline, a key part of the tool string is the stem, which is used to overcome stuffing box packing friction as the line passes from outside the well head into the well bore. With a set of mechanical jars below the stem, the combined weight of the jars and stem is used to jar up or down by pulling and then releasing the wireline. The combination of gravity and momentum, acting on the stem and jars, creates the force to perform the necessary function acting through the tool which is at or near the end of the tool string. In many cases, when the tool has successfully performed its function, additional jarring is used to shear a pin to release the tool from the work or newly-installed part. The tool string is then retrieved to the surface with the wireline. Wireline is most effective in near vertical wells, as the effects of gravity on the tool string diminish rapidly as the well bore departs from the vertical.

The most significant downhole problem that can occur with the use of a wireline is breaking of the wire, stranding a tool string in the flowline. This necessitates an additional maintenance action of retrieving the stranded tool string. This is usually accomplished by fishing with another tool string to acquire either the broken wire or the fishneck of the stranded tool string.

Pumpdown or through-flowline (TFL) service systems use hydraulic pressure and flow to provide the force required for tool movement and manipulation. In any TFL service system, there are five basic components: (1) a pump to provide power at the surface, (2) fluid to convert the pump power to work, (3) a circulation member to provide a complete circulation path, (4) a suitable conduit to carry the working fluid and (5) a tool string to perform the needed transport and service.

A TFL service system requires a fluid circulation path from a central service station into a well, through a communication port, and then returning to the point of origin. This path may be through the tubing/casing annulus, dual tubing strings or tubing side string in single or multiple zone completions. A hydraulic pump provides the hydraulic power and fluid flow to move the tool string through the circulation path to the desired depth in the well and to accomplish work downhole. A hydraulic manifold is controlled from the TFL operator's console at the surface. The manifold allows for the required fluid direction changes during a service action. Typical TFL service fluids are seawater, dead crude oil or diesel fuel. The TFL tool string consists of elastomeric piston units that convert the fluid flow into force to provide tool manipulation downhole.

TFL techniques are particularly useful for subsea completions, directional holes drilled from offshore platforms and/or deep, deviated holes where wireline work is sometimes impossible or, at best, extremely difficult. TFL provides additional power beyond that capable with wireline service equipment to cut through extreme paraffin deposits, jet-erode stubborn sand bridges and accomplish other downhole maintenance tasks effectively. The greatest drawback to TFL systems is the extended fluid circulation path which connects to the pump at the surface. Thus, both wireline and TFL systems require some physical connection to the wellhead.

Plunger lift systems have much narrower application than wireline or TFL systems. Plunger lift is used primarily to unload excess fluids from a gas well or to increase production on an oil well. In these systems a tubing stop is inserted (usually by wireline) in the flowline at a desired depth, and a bumper spring is installed above the stop. The plunger is allowed to free-fall to the bumper spring. The plunger expands to the inside diameter of the flowline and the gas in the well lifts the plunger. The plunger is designed to surface as a solid interface between the fluid column and the lifting gas. As the plunger rises to the surface, the plunger acts as a swab, removing liquids in the tubing string. When the plunger rises to the surface, the liquids and gases are diverted to separate flowlines. The plunger may be used repeatedly to remove successively more of the accumulated liquid in the well or may be retrieved from the wellhead. The system may be automated or manually controlled.

Unfortunately, each of the above-described systems fails to address automatic selection and deployment of tools appropriate to the job to be performed. Accordingly, what is needed in the art is an automated system capable of selecting and acquiring an oil/gas well tool, deploying the tool to the required location downhole, performing the required task and returning to the wellhead.

SUMMARY OF THE INVENTION

To address the above-discussed deficiencies of the prior art, the present invention provides a system for, and method of deploying a selected one of a plurality of tools into a subterranean well and a well employing the system or the method. In one embodiment, the system includes: (1) a tool selector capable of receiving each of the plurality of tools into a separate location thereof and placing a selected one of the plurality of tools proximate an entrance to the subterranean well in response to a tool selection command and (2) a tool displacement mechanism, couplable to the selected one of the plurality of tools, that causes the selected one of the plurality of tools to enter and traverse at least a portion of the subterranean well.

The present invention therefore introduces the broad concept of automating the selection and deployment of a variety of tools for a given well. A computer can be adapted to control the selection, deployment, operation and retrieval of tools, providing remote completion, servicing and rework of a well.

In one embodiment of the present invention, the tool selector comprises a plurality of tool containment chambers corresponding to the plurality of tools, the tool selector moving a selected one of the plurality of tool containment chambers proximate the entrance in response to the tool selection command. "Tool containment chambers," as that phrase is used above, is broadly defined to include any station or interface for receiving, holding and releasing a tool. A "tool containment chamber" can be, but is not required to be, an enclosure for a tool.

In one embodiment of the present invention, the tool selector comprises a tool guide extending a location proximate the selected one of the plurality of tools to a location proximate the entrance, the tool guide being movable to select the selected one of the plurality of tools. Instead of moving a tool chamber toward the entrance of the well, a tool guide can be placed to provide a channel for tool travel from a fixed-location chamber. The tool guide can be a tube, chute, rail or other structure for conveying the tool toward (or away from) the well entrance.

In one embodiment of the present invention, the tool selector rotates about a substantially vertical axis to select the selected one of the plurality of tools. In this embodiment, the tool selector may be thought of as operating like a revolver. In an alternative embodiment, the tool selector translates linearly to select the selected one of the plurality of tools. Of course, those skilled in the art may perceive other advantageous chamber configurations and deployment operations.

In one embodiment of the present invention, the selected one of the plurality of tools is adapted to free-fall through at least a portion of the subterranean well. Alternatively, the selected one of the plurality of tools can traverse the subterranean well in a more controlled manner.

In one embodiment of the present invention, the tool displacement mechanism comprises a tractor adapted to engage an inner wall of the subterranean well. Alternatively, the tool displacement mechanism may be driven by pneumatic or hydraulic pressure in the wellbore or lowered or raised by wire line or other tension member.

In one embodiment of the present invention, the tool displacement mechanism comprises a locator that determines a location of the tool displacement mechanism within the subterranean well. The locator may be of any conventional or novel construction. Of course, a locator is not necessary to the broad scope of the present invention.

In one embodiment of the present invention, each of the plurality of tools is coupled to a separate tool displacement mechanism. Alternatively, one tool displacement mechanism may be removably couplable to whichever one of the plurality of tools is desired to be deployed into the subterranean well.

In one embodiment of the present invention, the tool displacement mechanism comprises a coupling adapted to couple the tool displacement mechanism to a wire line retriever. Those skilled in the art are familiar with the structure and function of conventional wire line retrieval systems. The present invention is adapted to operate with any conventional or later-designed, surface-based deployment or retrieval system.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
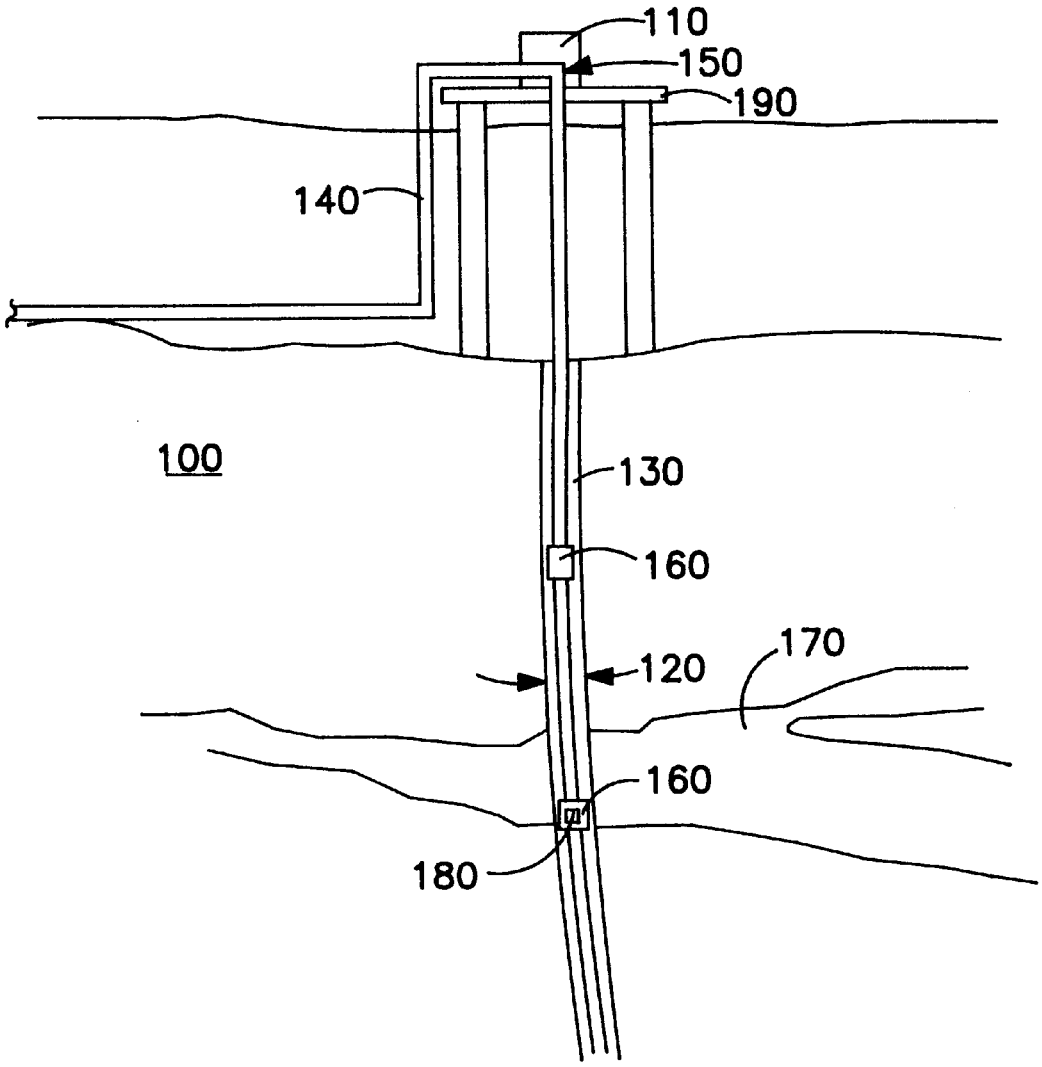
FIG. 1 illustrates an elevational view of an exemplary oil well.

Referring initially to FIG. 1, illustrated is an elevational view of an exemplary oil well. The well, generally designated 100, comprises a well head 110, a subterranean wellbore 120 and a well casing 130. Those skilled in the art are familiar with the configuration of a typical oil well. The well head 110 may be on land or atop an offshore drilling and production platform 190. At the well head 110, provisions are made to route the well production, oil and/or gas, to the distribution plumbing 140. Access to complete or service the well is provided through an entrance 150 to the casing 130 at the surface (land or offshore platform). The well 100 will typically contain a plurality of landing nipples 160 designed to accommodate safety valves, lock mandrels or other devices within the flow conductor of the well 100. Those skilled in the art are familiar with oil well safety valves and lock mandrels. The well 100 must pass through at least one subterranean production zone 170 to be commercially viable. At the subterranean production zone 170, the casing 130 may comprise a manipulable valve 180 to control production flow.

Figure 2:
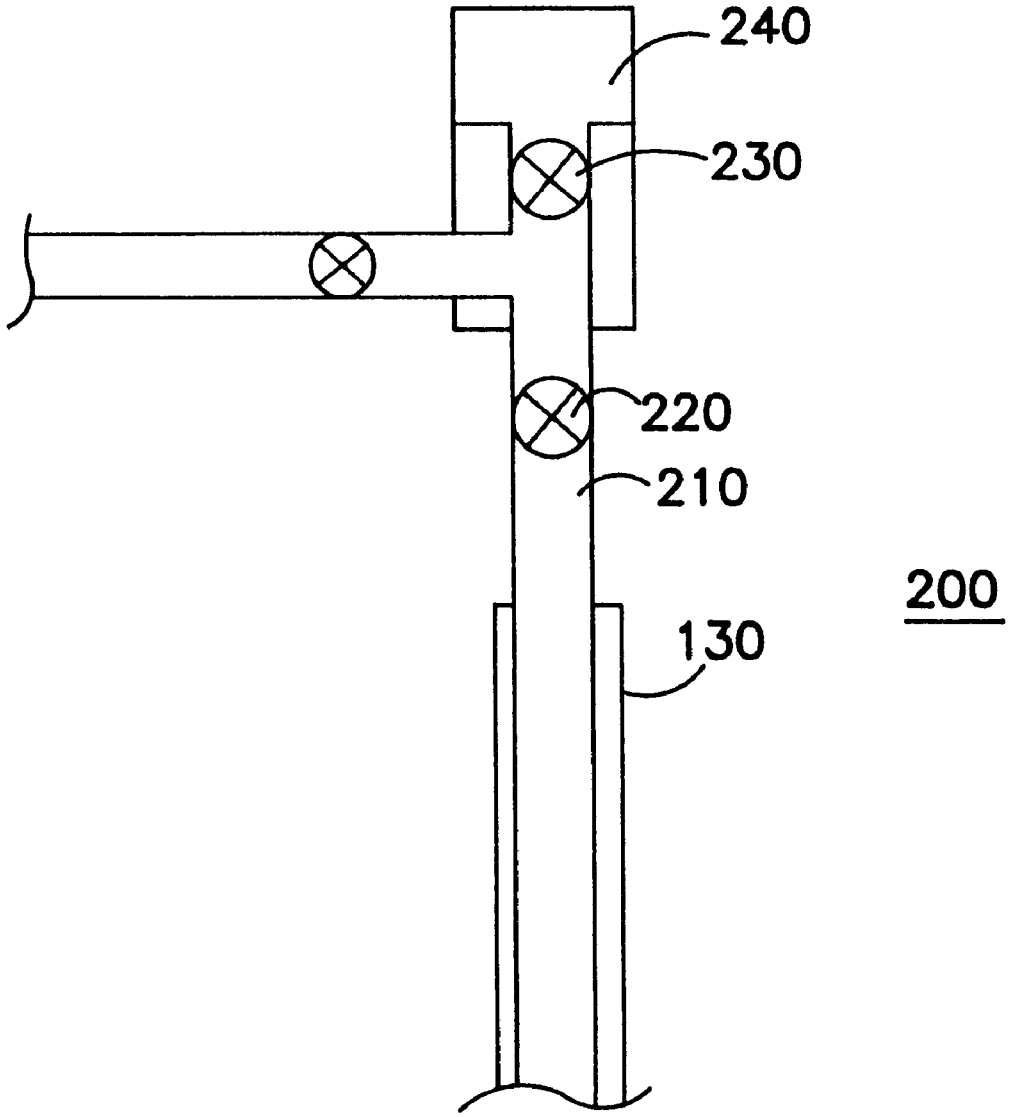
FIG. 2 illustrates a sectional view of a well head shown in FIG. 1 that employs a servicing and completion system constructed according to the principles of the present invention.

Referring now to FIG. 2, illustrated is a sectional view of the well head of FIG. 1 employing a servicing and completion system constructed according to the principles of the present invention. The well head 200 comprises the well casing 130, production tubing 210, a master valve 220, a servicing system valve 230 and a servicing and completion system 240. The master valve 220 allows complete shutdown of the well production if necessary. The servicing system valve 230 is interposed between the production tubing 210 and the servicing and completion system 240 to allow the servicing and completion system 240 to be maintained with pressure in the production tubing 210. Those skilled in the art will recognize that various valve and pump configurations within and adjacent to the servicing and completion system 240 may be necessary to operate the servicing and completion system 240 while the well is still in operation without affecting the scope and intent of the present invention.

Figure 3:
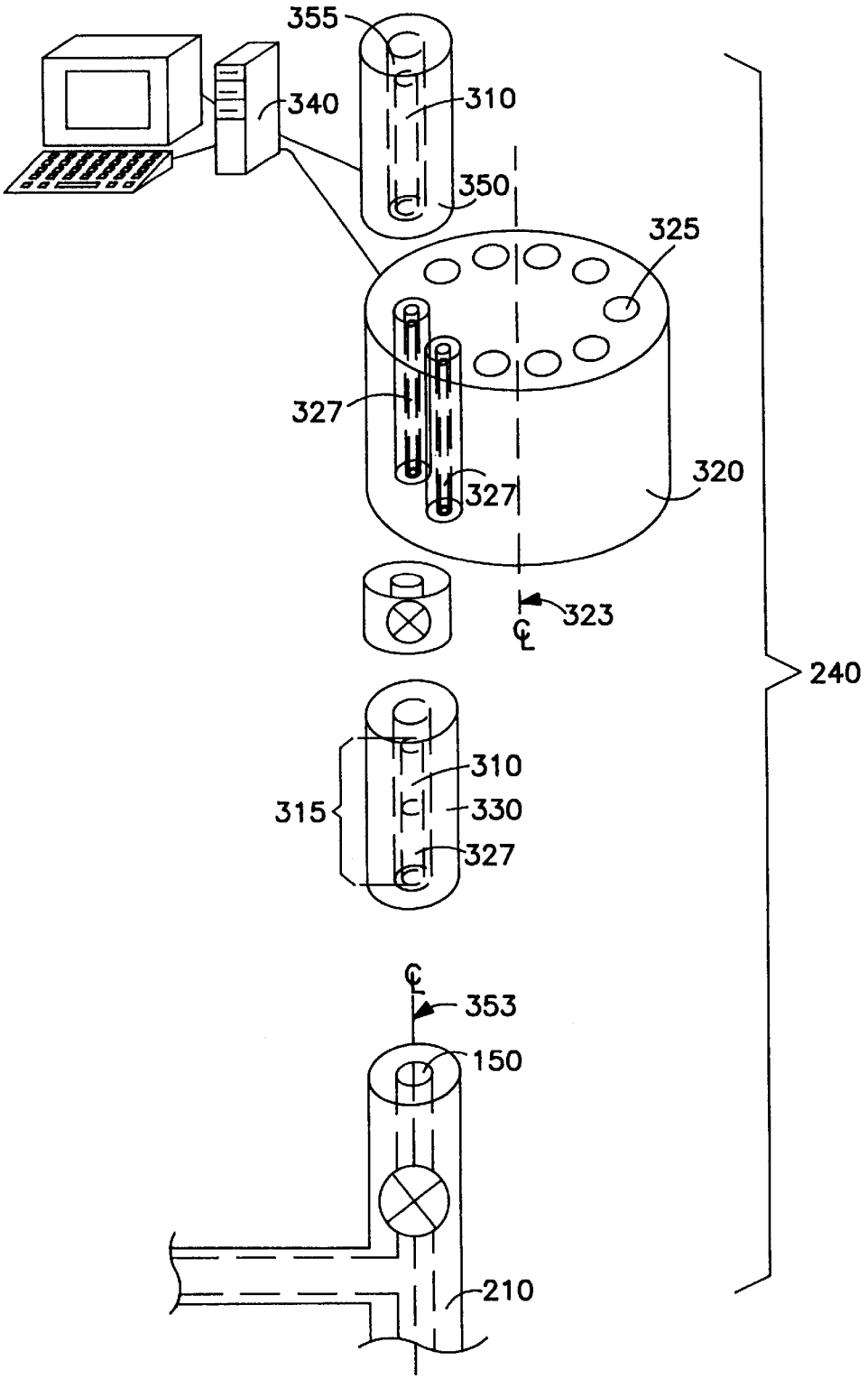
FIG. 3 illustrates an exploded isometric view of one embodiment of the servicing and completion system of FIG. 2.

Referring now to FIG. 3, illustrated is an exploded isometric view of one embodiment of the servicing and completion system of FIG. 2. Essential elements of the servicing and completion system 240 are: a tool displacement mechanism 310, a tool selector 320 and a tool guide 330. In the illustrated embodiment, the tool displacement mechanism 310 is stored in a chamber 355 within a housing 350. The housing 350 provides the interface between the tool displacement mechanism 310 and the system computer 340. Commands from the computer 340 direct the tool displacement mechanism 310 as to: (a) what task to perform, (b) where in the wellhead/wellbore to perform the task and (c) when to perform the task.

In the illustrated embodiment, the tool selector 320 comprises a plurality of longitudinal tool containment chambers 325 located radially about an essentially vertical axis 323. The tool selector 320 holds a corresponding plurality of well completion and maintenance tools 327 to perform a variety of tasks within the subterranean well 100. Those skilled in the art are familiar with oil well subsurface tools and their employment. The tool selector 320 is circular in cross section and rotates about the essentially vertical axis 323 which is offset from the axis 353 of the entrance 150 to the subterranean well 100. By rotating the tool selector 320 about its vertical axis 323, access to the well 100 (through the tool guide 330) is provided for a tool 327 chosen by the computer 340 from among the plurality of tools 327 within the tool selector 320. The tool guide 330 is located proximate the end of one chamber 325 of the tool selector 320 and extends to a location proximate the entrance 150 to the well 100.

In the illustrated embodiment, the tool selector 320, when directed by the computer 340, rotates so as to provide access to the entrance 150 to the well 100 (via the tool guide 330) for the tool 327 selected from among the plurality of tools. The computer 340 next commands the tool displacement mechanism 310 to mate with the selected tool 327 using, if necessary, a tractor mechanism to be described below. This combination of a tool displacement mechanism 310 and a tool 327 comprise a tool string 315. At this point, the tool string 315 may be held temporarily in the tool guide 330 which is sealed to the entrance 150 to the subterranean well 100. The computer 340 commands the master valve 220 to open, and the tool string 315 is allowed to free-fall at least some distance into the well 100. The tool displacement mechanism 310 may employ frictional methods or other means to slow the descent in the production tubing 210. When necessary, due to lack of gravity effect on the tool string 315, the tool displacement mechanism 310 propels itself and the tool 327 through the production tubing 210 by a tractor mechanism which engages the inner wall of the production tubing 210. The tool displacement mechanism 310 monitors the location of the tool string 315 in the production tubing 210. When the tool displacement mechanism 310 determines that the tool string 315 is in the proper location, the tool displacement mechanism 310 manipulates the tool 327 to accomplish the task assigned by the computer. For example, if the tool string 315 is located in the landing nipple 160 of FIG. 1 within a subterranean production zone 170, the tool displacement mechanism 310 may operate to open or close a production valve 180 located within the landing nipple 160. When the task is complete, the tool displacement mechanism 310, reconfigures the tool string 315, activates a surfacing mechanism (to be described below) and returns the tool string 315 to the well head 110.

In the illustrated embodiment, a single tool displacement mechanism 310 mates with a selected one of the tools 327 from within the tool selector 320. In an alternative embodiment, each tool 327 may be equipped with its own tool displacement mechanism 310 and stored within a suitably extended tool selector 320. In yet another alternative embodiment, the tool displacement mechanism 310 may be stored in one chamber 325 of the tool selector 320. After locating the selected tool 327 in the tool guide 330, the tool selector 320 rotates to align the chamber 325 containing the tool displacement mechanism 310 which mates with the selected tool 327 and performs the commanded task as described above. However, one skilled in the art will recognize that the storage location of the tool displacement mechanism 310 as well as the location of the mating of the tool displacement mechanism 310 and the selected tool 327 may occur in a variety of locations within the servicing and completion system 240, e.g., the tool guide 330, the tool selector 320, etc., while remaining within the scope and intent of the present invention.

Figure 4:
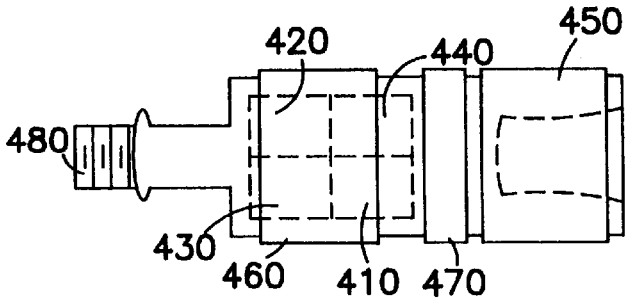
FIG. 4 illustrates a functional cross sectional view of one embodiment of the tool displacement mechanism of FIG. 3.

Referring now to FIG. 4, illustrated is a functional cross sectional view of one embodiment of the tool displacement mechanism of FIG. 3. The tool displacement mechanism 310 is illustrated as being a self-contained, powered module capable of receiving, storing and performing commands from the central computer 340.

The tool displacement mechanism 310 comprises a power source 410, memory 420, central processing unit 430, location monitor system 440, traction mechanism 450, free-fall restrictor 460, surfacing mechanism 470 and retrieval coupling 480. Those skilled in the art will recognize that for the purposes of this discussion the location and nature of the above components is not limited by the illustration and may be varied while remaining within the scope of the present invention.

The power source 410 provides all power for the tool displacement mechanism 310, including, but not limited to: computer operation and memory maintenance, location monitoring, module reconfiguration, system traction and task completion. The mechanism memory 420 stores all essential instructions provided by the system computer 340 to enable the tool displacement mechanism 310 to operate independently of the system computer 340. The central processing unit 430, in conjunction with motion and/or location sensors, determines the location of the tool string 315 within the well 100. The location monitor system 440 may comprise, but is not limited to: inertial, pressure, mandrel identification or magnetic sensors.

As necessary, the central processing unit 430 reconfigures the tool displacement mechanism 310 to: (a) slow the tool string 315 free-fall, (b) initiate traction along the production tubing 210, (c) perform an assigned task, (d) report a system malfunction and (e) return to the well head 110. Under normal conditions following task completion, the central processing unit 430 reconfigures the tool displacement mechanism 310 to deploy the surfacing mechanism 470 so that well pressure will carry the tool string 315 back to the surface.

Alternatively, should pressure in the well 100 be insufficient to raise the tool string 315, the tool displacement mechanism 310 may reconfigure to permit the traction mechanism 450 to move the tool string 315 to a location in the wellbore where pressure is sufficient to raise the tool string 315. However, in the event of a system malfunction, the problem may be reported to the computer 340 for further action or retrieval. In the event of a stranded tool string 315, the string may be retrieved by dispatching another tool displacement mechanism 310 with a fishing socket to retrieve the stranded tool string 315 by means of the retrieval coupling 480. In the event that a second tool displacement mechanism 310 is not available or is unable to retrieve the stranded tool string 315, a wireline equipped with a fishing socket can be employed to retrieve the stranded tool string 315 by means of the retrieval coupling 480. Those skilled in the art are familiar with wireline retrieval of stranded tool strings.

Figure 5:
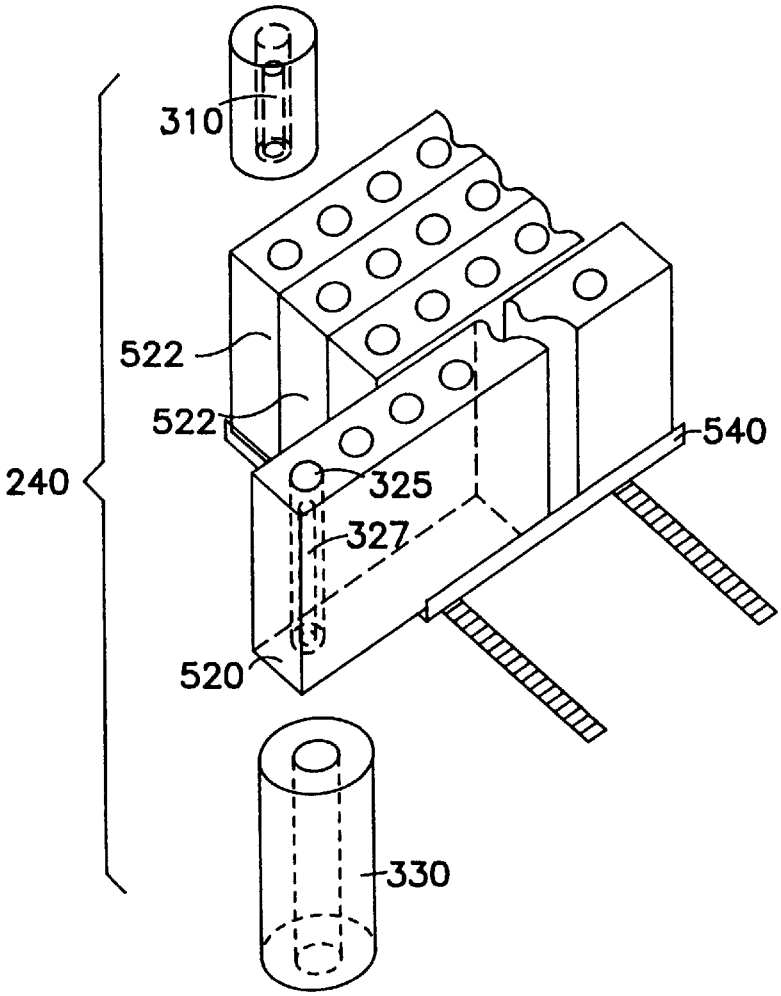
FIG. 5 illustrates an exploded isometric view of an alternative embodiment of the servicing and completion system of FIG. 3.

Referring now to FIG. 5, illustrated is an exploded isometric view of an alternative embodiment of the servicing and completion system of FIG. 3. In the illustrated embodiment, the servicing and completion system 240 is equipped with a linear tool selector 520 containing a plurality of tool containment chambers 325. In this embodiment, the tool selector 520 translates under command of the computer 340 so as to align the selected tool containment chamber 325 with the tool guide 330 and the tool displacement mechanism 310.

Operation of this system, and the remaining embodiments to be described, is the same as the servicing and completion system of FIG. 3. Significant advantages accrue to this embodiment in that the number of containment chambers 325 in a tool selector 520 is not limited by the circumference of the circular tool selector 320 of FIG. 3. Also note that in the illustrated embodiment additional linear tool selectors 522 may be assembled in a rack 540 so as to be parallel to the primary tool selector 520. Thus, additional tools 327 can be accommodated by translating the rack 540 transverse to the linear tool selector's line of motion until the selector 522 with the desired tool 327 is aligned with the tool guide 330.

The tool displacement mechanism 310 mates to the selected tool 327 in a similar manner to that described above, thus comprising a tool string 315. In an alternative embodiment, the tool displacement mechanism 310 may be stored in one chamber 325 of the tool selector 520. The tool selector 520 may then translate to align with the tool displacement mechanism 310 which mates with the selected tool 327 and performs the commanded task as described above.

Figure 6:
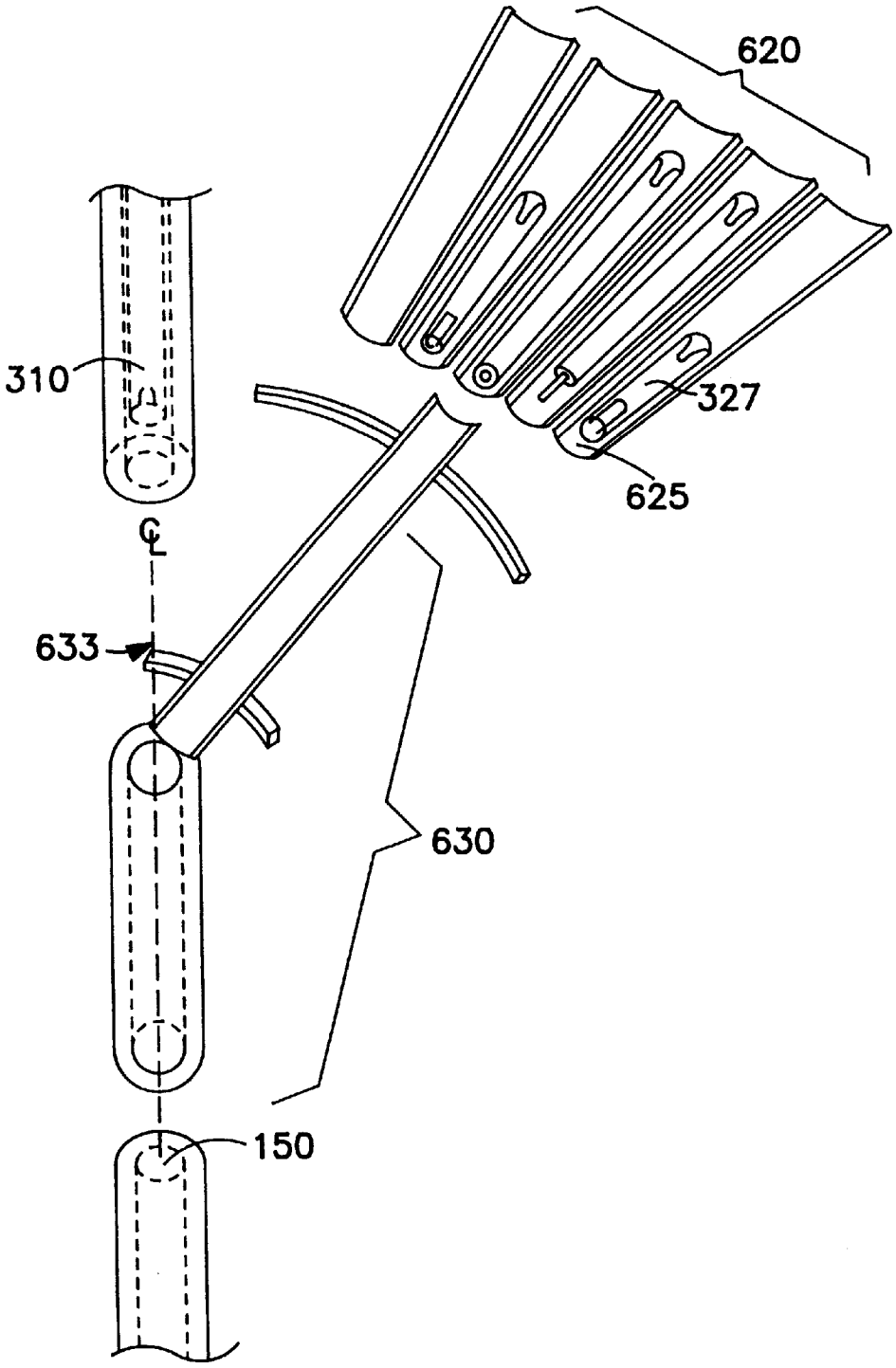
FIG. 6 illustrates an exploded isometric view of an alternative embodiment of the servicing and completion system of FIG. 3.

Referring now to FIG. 6, illustrated is an exploded isometric view of an alternative embodiment of the servicing and completion system of FIG. 3. In this embodiment, the tool containment chambers 625 of the tool selector 620 are radially aligned from the well entrance 150. The tool containment chambers 625 may be channels or tubes as desired. Likewise, the tool guide 630 is a channel or tube, or combination thereof, by which the selected tool 327 is guided to the well entrance 150.

In this embodiment, the tool guide 630 rotates about an essentially vertical axis 633 to align with the selected tool 327 which is conveyed onto the tool guide 630 and to the well entrance 150. The tool displacement mechanism 310 is stored separately and mated with the selected tool 327 after the tool is located in the tool guide 630.

In an alternative embodiment, the tool displacement mechanism 310 may be stored in one chamber 625 of the tool selector 620. The tool guide 630 may then rotate to align with the tool displacement mechanism 310 which mates with the selected tool 327 and performs the commanded task as described above. In another alternative embodiment, the tool guide 630 may be stationary, and the tool selector 620 translate so as to align the selected tool chamber 625 with the tool guide 630. The system then performs as described above.

From the above, it is apparent that the present invention provides a system for, and method of deploying a selected one of a plurality of tools into a subterranean well and a well employing the system or the method. In one embodiment, the system includes: (1) a tool selector capable of receiving each of the plurality of tools into a separate location thereof and placing a selected one of the plurality of tools proximate an entrance to the subterranean well in response to a tool selection command and (2) a tool displacement mechanism, couplable to the selected one of the plurality of tools, that causes the selected one of the plurality of tools to enter and traverse at least a portion of the subterranean well.

Although the present invention has been described in detail, those skilled in the art should understand that they can make various changes, substitutions and alterations herein without departing from the spirit and scope of the invention in its broadest form.

What is claimed is:

1. A system for deploying a selected one of a plurality of tools into a subterranean well, comprising:

a tool selector capable of receiving each of said plurality of tools into a separate location thereof and placing a selected one of said plurality of tools proximate an entrance to said subterranean well in response to a tool selection command; and a tool displacement mechanism, having an attachment mechanism associated therewith that is configured to attach said selected one of said plurality of tools to said tool displacement mechanism and that causes said selected one of said plurality of tools to enter and traverse at least a portion of said subterranean well.

2. The system as recited in claim 1 wherein said tool selector comprises a plurality of tool containment chambers corresponding to said plurality of tools, said tool selector moving a selected one of said plurality of tool containment chambers proximate said entrance in response to said tool selection command.

3. The system as recited in claim 1 wherein said tool selector comprises a tool guide extending a location proximate said selected one of said plurality of tools to a location proximate said entrance, said tool guide being movable to select said selected one of said plurality of tools.

4. The system as recited in claim 1 wherein said tool selector rotates about a substantially vertical axis to select said selected one of said plurality of tools.

5. The system as recited in claim 1 wherein said tool selector translates linearly to select said selected one of said plurality of tools.

6. The system as recited in claim 1 wherein said selected one of said plurality of tools is adapted to free-fall through at least a portion of said subterranean well.

7. The system as recited in claim 1 wherein said tool displacement mechanism comprises a tractor adapted to engage an inner wall of said subterranean well.

8. The system as recited in claim 1 wherein said tool displacement mechanism comprises a locator that determines a location of said tool displacement mechanism within said subterranean well.

9. The system as recited in claim 1 wherein each of said plurality of tools is coupled to a separate tool displacement mechanism.

10. The system as recited in claim 1 wherein said tool displacement mechanism comprises a coupling adapted to couple said tool displacement mechanism to a wire line retriever.

11. A method of deploying a selected one of a plurality of tools into a subterranean well, comprising the steps of:

receiving each of said plurality of tools into a separate location of a tool selector;

placing a selected one of said plurality of tools proximate an entrance to said subterranean well in response to a tool selection command; and causing said selected one of said plurality of tools to enter and traverse at least a portion of said subterranean well with a tool displacement mechanism having an attachment mechanism associated therewith that is configured to attach said selected one of said plurality of tools to said tool displacement mechanism.

12. The method as recited in claim 11 wherein said tool selector comprises a plurality of tool containment chambers corresponding to said plurality of tools, said step of placing comprising the step of moving a selected one of said plurality of tool containment chambers proximate said entrance in response to said tool selection command.

13. The method as recited in claim 11 wherein said tool selector comprises a tool guide extending a location proximate said selected one of said plurality of tools to a location proximate said entrance, said step of placing comprising the step of moving said tool guide to select said selected one of said plurality of tools.

14. The method as recited in claim 11 wherein said step of placing comprises the step of rotating said tool selector about a substantially vertical axis to select said selected one of said plurality of tools.

15. The method as recited in claim 11 wherein said step of placing comprises the step of translating said tool selector linearly to select said selected one of said plurality of tools.

16. The method as recited in claim 11 further comprising the step of allowing said selected one of said plurality of tools to free-fall through at least a portion of said subterranean well.

17. The method as recited in claim 11 further comprising the step of engaging a tractor of said tool displacement mechanism with an inner wall of said subterranean well.

18. The method as recited in claim 11 wherein said tool displacement mechanism comprises a locator, said method comprising the step of determining a location of said tool displacement mechanism within said subterranean well.

19. The method as recited in claim 11 wherein each of said plurality of tools is coupled to a separate tool displacement mechanism.

20. The method as recited in claim 11 wherein said tool displacement mechanism comprises a coupling, said method further comprising the step of coupling said coupling of said tool displacement mechanism to a wire line retriever.

21. A subterranean well, comprising:

a wellbore having a casing therein and an entrance at a surface level thereof, said wellbore passing through at least one subterranean production zone and containing at least one manipulable structure at a location along a length thereof; and a system for deploying a selected one of a plurality of tools into said wellbore to manipulate said manipulable structure, including:

a tool selector capable of receiving each of said plurality of tools into a separate location thereof and placing a selected one of said plurality of tools proximate said entrance in response to a tool selection command, and a tool displacement mechanism, having an attachment mechanism associated therewith that is configured to attach said selected one of said plurality of tools to said tool displacement mechanism and that causes said selected one of said plurality of tools to enter and traverse at least a portion of said subterranean well to arrive at said manipulable structure.

22. The well as recited in claim 21 wherein said tool selector comprises a plurality of tool containment chambers corresponding to said plurality of tools, said tool selector moving a selected one of said plurality of tool containment chambers proximate said entrance in response to said tool selection command.

23. The well as recited in claim 21 wherein said tool selector comprises a tool guide extending a location proximate said selected one of said plurality of tools to a location proximate said entrance, said tool guide being movable to select said selected one of said plurality of tools.

24. The well as recited in claim 21 wherein said tool selector rotates about a substantially vertical axis to select said selected one of said plurality of tools.

25. The well as recited in claim 21 wherein said tool selector translates linearly to select said selected one of said plurality of tools.

26. The well as recited in claim 21 wherein said selected one of said plurality of tools is adapted to free-fall through at least a portion of said subterranean well.

27. The well as recited in claim 21 wherein said tool displacement mechanism comprises a tractor adapted to engage an inner wall of said subterranean well.

28. The well as recited in claim 21 wherein said tool displacement mechanism comprises a locator that determines a location of said tool displacement mechanism within said subterranean well.

29. The well as recited in claim 21 wherein each of said plurality of tools is coupled to a separate tool displacement mechanism.

30. The well as recited in claim 21 wherein said tool displacement mechanism comprises a coupling adapted to couple said tool displacement mechanism to a wire line retriever.

* * * * *